US006183888B1

(12) United States Patent
Alperine et al.

(10) Patent No.: US 6,183,888 B1
(45) Date of Patent: Feb. 6, 2001

(54) PROCESS FOR PRODUCING A COATING FOR PROVIDING SUPERALLOYS WITH HIGHLY EFFICIENT PROTECTION AGAINST HIGH-TEMPERATURE CORROSION, A PROTECTIVE COATING FORMED BY THE PROCESS, AND ARTICLES PROTECTED BY THE COATING

(75) Inventors: Alexandre Serge Alperine, Paris; Jean-Paul Fournes, Dannemois; Louis Jacques Leger, Combs la Ville, all of (FR)

(73) Assignee: Societe Nationale d'Etude et de Construction de Moteurs d'Aviation "SNECMA", Paris (FR)

( * ) Notice: Under 35 U.S.C. 154(b), the term of this patent shall be extended for 0 days.

(21) Appl. No.: 08/989,059

(22) Filed: Dec. 11, 1997

(30) Foreign Application Priority Data

Dec. 12, 1996 (FR) ..... 96 15257

(51) Int. Cl.[7] ..... B32B 15/01; B32B 15/00; C25D 5/10; C25D 5/12

(52) U.S. Cl. ..... 428/670; 428/678; 428/680; 205/176; 205/178; 205/184; 205/224; 205/227; 205/228; 148/430; 148/518

(58) Field of Search ..... 205/176, 178, 205/184, 224, 227, 228; 427/547, 546, 614, 670, 678, 680, 376.7; 148/518, 430

(56) References Cited

U.S. PATENT DOCUMENTS 4,123,594 * 10/1978 Chang ..... 428/651
4,123,595 * 10/1978 Chang ..... 428/667
4,714,624 * 12/1987 Naik ..... 427/34
5,141,821 * 8/1992 Lugscheider et al. ..... 428/614
5,427,866 * 6/1995 Nagara et al. ..... 428/610
5,495,386 * 2/1996 Kulkarni ..... 361/303
5,645,893 * 7/1997 Rickerby et al. ..... 427/405

FOREIGN PATENT DOCUMENTS 1 955 203 * 5/1971 (DE) .
0 587 341 A1 * 3/1994 (EP) .
587341 * 3/1994 (EP) .
2 018 097 * 5/1970 (FR) .
2 226 484 * 11/1974 (FR) .
2 529 911 * 1/1984 (FR) .
2 559 508 * 8/1985 (FR) .
2 638 174 * 4/1990 (FR) .
2 002 420 * 2/1979 (GB) .
WO 94/18359 * 8/1994 (WO) .

OTHER PUBLICATIONS

Thermal Spraying: Practice, Theory, and Application, pp. 53–54, c.1985*.*

Patent Abstracts of Japan, vol. 004, No. 129 (c–024), Sep. 10, 1980 and JP 55 082760 A (Hitachi LTd), Jun. 21, 1980.*

* cited by examiner

*Primary Examiner*—Edna Wong
(74) *Attorney, Agent, or Firm*—Oblon, Spivak, McClelland, Maier & Neustadt, P.C.

(57) ABSTRACT

A process for producing a coating for protecting superalloy articles against high temperature oxidation and hot corrosion comprises forming, on the surface of the article, a first deposit of an agglomerated powdered alloy containing at least chromium, aluminum and an active element, and filling the open pores of the powder deposit by a second, electrolytically applied, deposit of a precious platinum group metal. An appropriate thermal treatment is then carried out to effect interdiffusion between the powder based deposit and the electrolytic deposit and produce a coating including chromium, an active element such as yttrium, and a precious platinum group metal throughout its thickness.

14 Claims, 2 Drawing Sheets

| DENOMINATION % BY WEIGHT | Ni | Co | Cr | Al | Y | OTHERS |
|---|---|---|---|---|---|---|
| 1) NiCoCrAlY | base | 23,0 | 20,0 | 8,5 | 0,60 | -- |
| 2) CoNiCrAlY+Ta | 9,8 | base | 23,8 | 7,3 | 0,55 | Ta 4,9 |
| 3) NiCoCrAlY+Ta | base | 23,0 | 20,0 | 8,5 | 0,60 | Ta 4,0 |
| 4) NiCrAlY | base | -- | 22,0 | 10,0 | 1,00 | -- |

| DEPTH µm | Al | Cr | Co | Ni | Pd | Ti | Hf |
|---|---|---|---|---|---|---|---|
| 0 | 52,8 | 1,2 | 3,3 | 19,9 | 22,2 | 0 | 0 |
| 5 | 54,2 | 0,8 | 2 | 20,8 | 22,2 | 0 | 0 |
| 15 | 52,8 | 0,6 | 6,2 | 27,2 | 12,7 | 0 | 0 |
| 20 | 48,8 | 1,4 | 14,6 | 30,6 | 4,6 | 0 | 0 |
| 30 | 41,8 | 3,8 | 10,5 | 34,3 | 9,2 | 0,4 | 0 |
| 50 | 37,5 | 5,3 | 11,3 | 38 | 6,1 | 1,4 | 0 |
| 60 | 35,7 | 5,7 | 11,8 | 40 | 4,6 | 1,4 | 0 |
| 70 | 33,7 | 6 | 11,4 | 42,8 | 3,6 | 2 | 0 |
| 80 | 10,8 | 9,4 | 9,9 | 61,7 | 0 | 2,7 | 0,6 |
| 90 | 10,8 | 9,4 | 9,9 | 61,7 | 0 | 2,7 | 0,6 |

PROCESS FOR PRODUCING A COATING FOR PROVIDING SUPERALLOYS WITH HIGHLY EFFICIENT PROTECTION AGAINST HIGH-TEMPERATURE CORROSION, A PROTECTIVE COATING FORMED BY THE PROCESS, AND ARTICLES PROTECTED BY THE COATING

BACKGROUND OF THE INVENTION

1. Field of the Invention

The invention relates to a process for producing a coating for protecting superalloy articles against high-temperature oxidation and hot corrosion, a protective coating produced by such a process, and superalloy articles protected by the coating. The invention is applicable in particular to the protection of hot superalloy parts of turbomachines.

2. Summary of the Prior Art

For more than 30 years the manufacturers of turbine engines for both land and aeronautical use have been addressing demands for increased turbomachine efficiency, and reduction of specific fuel consumption and polluting emissions of the COX, SOX and NOX types as well as unburnt constituents. One way of meeting these demands is to study combustion fuel stoichiometry and thus increase the temperature of the gases issuing from the combustion chamber and impacting the first turbine stages. The materials used for the construction of the turbine must therefore be made compatible with these increased combustion gas temperatures. One solution is to develop a refractory nature for the materials used in order to increase the maximum working temperature and the working life in terms of creep and fatigue. This solution became widely used following the appearance of nickel and/or cobalt superalloys, and has undergone a considerable technical advance in the change from equiaxial superalloys to monocrystalline superalloys (a creep gain of 80 to 100° C.).

Another important development in turbine technology is connected to the new sales and guarantee practices in this field. The usual practice is for the customer to be given guarantees for the working lives of land and aeronautical turbines. It is therefore of considerable economic interest to a manufacturer of turbine engines to achieve a significant increase in the working life of the engine components, and particularly the components of the "hot" parts.

This raises the problem of increasing the protection of hot-part components against high temperature oxidation (T>approximately 950° C.) and hot corrosion (at intermediate temperatures in the presence of $SO_2/SO_3$ and deposits of melted sulphate and/or vanadate type salts).

There are two main categories of coatings for protecting superalloys against high-temperature oxidation and hot corrosion, these being simple coatings of aluminides and their derivatives, and alloy coatings.

Coatings belonging in the category of simple aluminides and their derivatives basically consist of a nickel aluminide alloy, NiAl, comprising an atomic percentage of aluminum between 40 and 55%. As a result of oxidation at high temperature this type of alloy forms a protective layer of aluminum oxide limiting interaction between the coating and the environment (oxygen, melted salts, $SO_2/SO_3$). These coatings can be deposited thermochemically by pot cementation or by vapour phase cementation. They can also be obtained by the deposition of an aluminizing paint followed by appropriate annealing. The main advantage of these coatings is simplicity of implementation, low production costs and the possibility of providing articles of complex shape with uniform coatings.

However, the performance of coatings of this type is limited. At high temperatures the alumina formed is stressed and adheres unsatisfactorily. It exfoliates readily during thermal cycling, leading to aluminum consumption and depletion in the outer part of the coating. This consumption seriously limits the working life of the coating, which provides very little protection once the aluminum reserve has been used up. As regards hot corrosion, the pure alumina layer formed may be dissolved by interaction with environments of melted sulphate salts or a mixture of sulphate and vanadate salts.

One good way of significantly increasing the working life of these coatings is to modify the simple aluminide NiAl by various elements such as chromium and/or some platinum group precious metals. The coating operation then takes the form of making an initial deposit of each modifying metal on the superalloy article, followed by an aluminization. In some cases a specific heat treatment is effected between the step of initial deposition of the modifying metal and the actual aluminization step.

The use of chromium as a modifying metal is described, for example, in French patent 2559508, wherein the chromium is applied thermochemically. The main function of the chromium is to limit the acidity or basicity of the melted salts in hot corrosion conditions by the dissolution of cations acting as an acido-basic buffer in the melted salt.

The use of platinum as a modifying metal is described in French patent 2018097. In this case the platinum is deposited electrolytically on the superalloy article. This precious metal is present in considerable proportions in solid solution in the β-NiAl phase of the nickel aluminide. It improves the adhesion of the protective alumina layer (cyclic oxidation) and also confers good resistance to the environment in the presence of melted salts (hot corrosion).

An alternative to the use of platinum as a modifying metal for simple aluminide coatings is to replace it by palladium. As French patent 2638174 teaches, the resulting coatings have a resistance to oxidation and hot corrosion which is equivalent to that of platinum-modified aluminides at a much lower cost.

Unlike coatings of simple aluminides and their derivatives, alloy coatings are not obtained by procedures involving high-temperature diffusion between the superalloy substrate and the coating during preparation. On the contrary, these coatings involve depositing on the substrate an already formed alloy of a composition suitable for the required purpose, such as resistance to oxidation and hot corrosion.

The alloy coatings most commonly used for high temperature protection of superalloy substrates are coatings of the MCrAlY type. In these coatings the symbol M represents the alloy base, which may be cobalt, nickel or iron, or a combination of two or more of these three metals. The chromium is present in a proportion of between 10 and 40% by weight, and serves mainly to increase the hot corrosion resistance of the coating. The aluminum is present in a proportion of between 2 and 25% by weight, its main function being the hot formation of a protective alumina layer which is required to be of slow growth, as chemically stable as possible to withstand hot corrosion, and to be very adhesive so as to withstand differential expansion stressing during high-temperature thermal cycling. Yttrium (Y) is present in proportions between a few tens of ppm and a few % by weight, and has two functions. Firstly, it can trap the residual sulphur of the alloys in the form of very stable sulphides and thus prevent the residual sulphur from hot diffusion towards the oxide/coating interface, where it tends to segregate and thus greatly limit the adhesion of the alumina layer. Secondly, it is incorporated in the form of mixed yttrium and aluminum oxides at the grain junctions of the alumina layer formed. These mixed oxides modify the diffusion mechanisms in the alumina to lead to the formation of an alumina free from residual growth stresses and therefore one which sticks much better to the coating. In general, yttrium is a powerful promoter of adhesion between the coating and the oxide in MCrAlY coatings.

Some other elements such as hafnium, zirconium, cerium, lanthanides and, in general, most of the rare earths can play a role very similar to that of yttrium as regards the adhesion of the protective alumina layers. Also, the contribution of yttrium and related elements, sometimes called active elements, to the effectiveness of the protective coatings of superalloys is limited solely to high-temperature oxidation. It has not been possible to show any active element effect in the case of hot corrosion of the coated superalloys.

Alloy coatings can be deposited by techniques such as:

Thermal plasma projection in air, in vacuo or in a controlled atmosphere;

HVOF (high velocity oxygen fuel) thermal projection and other thermal projection processes;

Detonation gun;

Explosion plating;

Electron bombardment evaporation;

Multi-arc plasma evaporation; and,

Cathodic sputter techniques.

All these techniques share a number of major disadvantages. They are costly to use, there are difficulties in controlling deposit quality, and there are difficulties in controlling the deposition of MCrAlY on articles having complex shape since the techniques are directional and cannot form a uniform coating on articles of complex shape.

As alternatives to using a coating of either of the two categories described above, a number of solutions have been developed.

A first solution is aluminized MCrAlY coatings. Pack or vapour phase aluminization on a MCrAlY coating deposited by one of the techniques already described has the advantage of obtaining an aluminum-enriched external composition of the coating, so that the working life thereof is prolonged, particularly in high temperature oxidation conditions. However, this solution is not very much better than a conventional MCrAlY application and suffers from the same limitation as regards cost and control of uniformity on articles of complex shape.

A second solution consists of electrophoretic MCrAlY coatings. The process for making this type of coating is described, for example, in French patent 2529911. The process comprises depositing a coating consisting of agglomerated powders of MCrAlY alloys on a nickel-based superalloy substrate by an adapted electrophoresis technique. Since this porous deposition has no mechanical strength the porosity must be filled by vapour phase aluminization. Aluminization serves to consolidate and fill the pores left between the agglomerated MCrAlY powder grains, and the final structure is very similar to that of a traditional aluminized MCrAlY coating.

The non-directional electrophoresis technique makes it possible to achieve uniform coatings on articles of complex shape, such as turbine distributor vane doublets. For an equivalent quality of protection this technique is much cheaper than a MCrAlY coating deposited by plasma and then aluminized. However, the resulting coating performs little better than a coating of MCrAlY on its own.

A third solution involves the combination of a plasma-deposited MCrAlY coating and a precious metal as described, for example, in EP-A-0587341. The coating is obtained by a process comprising the following steps:

(a) Deposition of MCrAlY alloy by thermal projection;

(b) Optional thermochemical chromizing;

(c) Thermochemical aluminization;

(d) Electrolytic deposition of platinum; and, (e) Diffusion heat treatment of the platinum deposit in the external part of the aluminized MCrAlY coating.

A major disadvantage of this coating is that it contains platinum only in its outer region. In fact the coating consists of a conventional MCrAlY coating and a superposed platinum modified aluminide coating. The beneficial effects of MCrAlY coatings and platinum-modified aluminide coatings are juxtaposed but are not additive. Synergy of the effect cannot therefore be achieved. Also, the total thickness of the coating is at least 100 $\mu$m, so that the extra weight may cause problems if the coating is used on rotating members. Furthermore, a coating of this kind is very expensive, its cost being at least equal to the sum of the costs of a traditional MCrAlY coating and of a platinum-modified aluminide coating. Finally, there is still an acute problem in coating objects of complex shape.

SUMMARY OF THE INVENTION

It is an object of the invention to obviate the disadvantages of the various known protective coatings described above and to this end the invention provides a process for producing a coating for protecting mechanical parts made of a superalloy against high-temperature oxidation and hot corrosion, said process comprising the steps of:

a) making a first deposit of a powdered alloy containing at least chromium, aluminum and an active element on the article to be coated such that said first deposit has a residual open porosity;

b) making a metallic electrolytic second deposit containing at least one platinum group metal on said first deposit so as to fill said residual open porosity of said first deposit; and, c) carrying out a heat treatment to effect interdiffusion between the powder first deposit and said electrolytic second deposit whereby said platinum group metal is present throughout the thickness of the protective coating.

The process in accordance with the invention enables a protective coating to be obtained which combines synergistically the beneficial effects of chromium and the active elements with the beneficial effects of adding a precious metal to the β-NiAl phase. It also avoids using directional deposition techniques so that a deposit of homogeneous thickness and quality can readily be made on articles of complex shape, and if necessary the total thickness of the coating can be limited to less than 100 $\mu$m.

Advantageously, a thermochemical aluminization treatment can be performed as a final step to provide an additional quantity of aluminum in the final coating and completely fill the residual gaps between the deposited powder grains.

As a variant, the invention also provides a process for producing a coating for protecting superalloy articles against high-temperature oxidation and hot corrosion, comprising the steps of:

a) making a first deposit of a powdered alloy containing at least chromium, aluminum, an active element and at least one platinum group metal on the article to be coated such that said deposit has a residual open porosity; and b) aluminizing said deposit so as to enrich the coating in aluminum and fill said residual open porosity.

The alloy powder may be deposited electrophoretically or by painting it on using a thermodegradable or volatile binder.

The active element may be selected from the group consisting of yttrium and yttrium or lanthanide rare earths such as Zr, Hf, La, and Ce.

The platinum group metal may be selected from the group consisting of platinum, palladium, rhodium, ruthenium, osmium, iridium and combinations of these metals.

Other preferred features and advantages of the invention will become apparent from the following non-limitative description of the preferred embodiments and examples, with reference to the accompanying drawings.

DESCRIPTION OF THE PREFERRED EMBODIMENTS AND EXAMPLES

Figure 1:
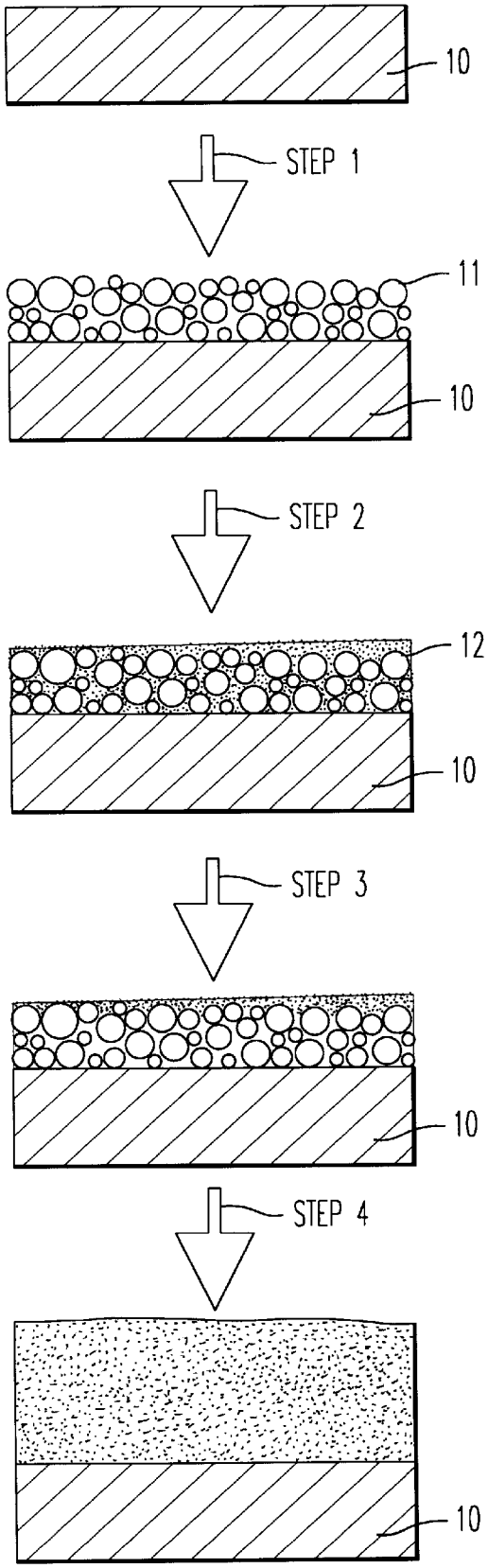
FIG. 1 shows a series of diagrams illustrating the evolution of the coating structure during various steps of a preferred embodiment of the coating process in accordance with the invention.

The production of a coating in accordance with one embodiment of the invention comprises a number of consecutive steps which will be described hereinafter with reference to FIG. 1.

The coating is deposited on a specimen 10 or article which is made of a nickel or cobalt-based superalloy (equiaxial, with directed solidification or monocrystalline) and which serves as a substrate. Non-limitative examples of suitable superalloys are those identified as IN100, DS200, DS186, MAR M 247, DS247, MAR M 509, René 77, René 125, HS31, X40, AM1, and AM3.

The first step 1 of the process for producing the coating is to make a first deposit 11 of an alloy on the surface of the specimen 10 or article to be coated, the deposit 11 being formed by the agglomeration of quasi-spherical powder grains of the alloy and having a residual porosity consisting mainly of the space left between the powder grains. The alloy powder used is of MCrAlY type with the following composition:

M is a base metal consisting of Ni and/or Co and/or Fe;

Cr present in a proportion of between 10 and 40% by weight;

Al present in a proportion of between 2 and 25% by weight; and

Y present in a proportion of between 0 and 2.5% by weight.

Figures 2, 3, 4:
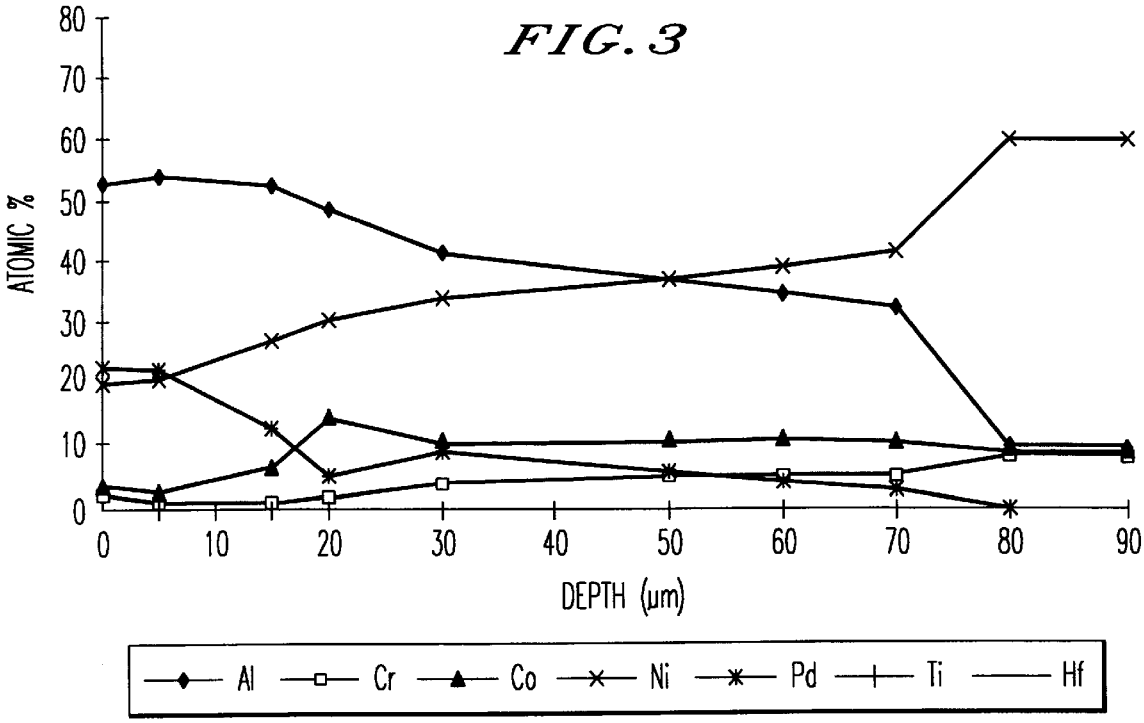
FIG. 2 is a table giving examples of compositions of an MCrAlY type alloy powder which can be used in making a coating in accordance with the invention.
FIG. 3 is a table indicating an example of the distribution (in atomic percentages), throughout the thickness of the coating, of the main elements in one embodiment of a coating in accordance with the invention; and, FIG. 4 is a graph plotting the distribution represented by the table in FIG. 3.

Preferred powder compositions which may by used are identified in the Table of FIG. 2.

Variants in the composition of these powders are possible without departing from the scope of the invention. For example, all or some of the active element Y may be replaced by one or more other active elements selected from the following list: Zr, Hf, La, Ce, and more generally the yttrium or lanthanide rare earths.

The grain size of the powder may be between 2 and 100 $\mu$m and is preferably between 4 and 15 $\mu$m. It is particularly advantageous to use a fine grain powder since this helps to limit the roughness of the final surface texture of the coating and to limit the size of the residual porosities after the electrophoretic deposition step. There is a corresponding decrease in the risk of porosity persisting in the coating after the final step of its production.

The first deposit may be made by using, for example, a painting technique using a thermodegradable or volatile binder or, more preferably, an electrophoretic technique. The electrophoretic technique comprises making a porous skeleton of metal powder by immersing the article to be coated in an isolating solution in which the powder to be deposited is contained in suspension. The suspension is homogenised by agitation so as to prevent sedimentation of the particles at the bottom of the electrophoresis vessel. The article to be coated is positioned and connected up as cathode. The anode consists of a shaped electrode disposed opposite and/or around the article to be coated in order to ensure a uniform distribution of the electric field near the article and, therefore, a uniform deposition thickness. The metal particles are electrically charged in the electrostatic field and migrate rapidly to the article surface where they are agglomerated by Coulombian attraction. The portions which are not to be coated are protected by masks made of materials chemically compatible with the electrophoresis bath. Support of the article in the tank and the electrical connections to the article are also dealt with by the arrangement including the masks. The potential difference applied between the anode and the cathode and producing the migration of the metal particles may be between 200 and 500 V. The deposition time may be between 1 second and 1 minute (typically less than 10 seconds) depending on the grain size of the powder to be deposited and the thickness of the required deposit.

As FIG. 1 shows, the deposited coating is not dense but is readily manipulable. The coyating thickness at this stage may be between 20 and 200 $\mu$m, and preferably between 30 and 60 $\mu$m, which, depending on the density and grain size of the powder used, corresponds to a deposited alloy density between 10 and 100 mg/cm$^2$, and preferably between 20 and 60 mg/cm$^2$.

The electrophoretic technique is particularly well suited to the first step of the process in accordance with the invention because it uses simple and low-cost equipment, and provides a uniform deposit, even on articles of complex shape. Also, the short deposition time makes it possible to achieve a high throughput rate in automated production, with a consequent reduction in the cost of this first step. Furthermore, the deposition efficiency—i.e. the weight of powder deposited as a proportion of the weight of powder used—is almost 100%, in contrast to conventional powder deposition techniques, such as thermal projection, and is therefore very attractive economically.

Step 2 of the coating process is the electrolytic deposition of a metallic deposit containing at least one platinum group metal. Preferably, this platinum group metal is pure platinum or a platinum-rhodium alloy or a palladium-nickel alloy.

After the specimen or article has been treated in step 1 it is immersed in an electrolytic deposition bath of the selected metal or alloy. An anode and/or current robber system is arranged around the specimen or article to be coated to ensure a uniform current density distribution over all the article, something which is achieved by using the skill of an electroplating expert. The cathode current density to be applied is chosen according to the operating parameters of the bath used. This current density is low enough for the electrolytic deposit to penetrate into all the gaps left between the powder grains deposited in step 1. The electrolysis time is adjusted so that the weight of precious metal deposited is between 5 and 70%, and preferably between 20 and 50%, of the total weight of the deposits made in steps 1 and 2.

At the end of step 2 the resulting coating 12 consists of the juxtaposition of the MCrAlY powder and the metallic alloy containing at least one platinum group metal.

The third step 3 is an annealing step serving to cause interdiffusion between the MCrAlY powder grains and the electrodeposited metallic alloy containing at least one platinum group metal. This annealing must be performed in a neutral atmosphere, such as argon, or in a reducing atmosphere such as hydrogen, or in a vacuum greater than $10^{-4}$ torr. The annealing temperature and duration depend upon:

the substrate superalloy, the composition of the MCrAlY powder, the grain size of the MCrAlY powder, the composition of the electrodeposited metal, and the possibility of a subsequent treatment step 4 as described below.

The annealing temperature may be between 750 and 1250° C. and the annealing time may be between 15 minutes and 48 hours (preferably between 2 and 16 hours). If no further treatment is to be performed, the annealing step must completely close the residual porosity of the coating and ensure that interdiffusion between the MCrAlY powder grains and the electrolytically deposited metal is complete. In this case higher annealing temperatures and/or longer annealing times will be necessary. If a further treatment step 4, as described below, is to be performed, some densification of the coating and interdiffusion between the MCrAlY powder grains and the electrolytic metal deposit will be achieved in step 4. The annealing temperatures and/or times can therefore be reduced.

Step 4 of the process in accordance with the invention is optional. It comprises aluminizing the coating by a conventional process familiar to a person skilled in the art. For example, this process may be a vapour phase aluminization or aluminization by the application of an aluminizing paint. Another possibility is to use a pot aluminization technique.

Step 4 produces aluminum enrichment of the external surface of the coating and thus prolongs the working life of the coating in high-temperature oxidation conditions. It also completes the filling of the gaps left between the powder grains deposited in step 1.

In a variant of the process in accordance with the invention, the first deposit effected in step 1 consists of a MCrAlY type alloy powder also containing one or more platinum group metals.

This addition of one or more platinum group metals can be achieved in various ways. It is possible to prepare a powder directly having a composition corresponding to the formula MCrAlY+MP, where MP is a platinum group metal or an alloy of such metals. The techniques for making such powders are known in the powder metallurgy art. In detail these consist of casting the alloy followed by a step of atomisation by arc or by rotating electrode. Another possibility is to use a conventional MCrAlY powder which has been given a subsequent surface treatment so as to deposit on the periphery of the grains an alloy containing the platinum group metal MP. This subsequent surface treatment may be, for example, a chemical deposition which may or may not be self-catalytic, an electrolytic deposition, or a PVD or CVD type organometallic deposition. MCrAlY+MP powders are also characterised by their content of the platinum group metal, MP. In the context of the invention the platinum group metal MP may represent between 2 and 60% by weight (preferably between 20% and 50% by weight), of the total powder weight.

This first deposit is then directly followed by an aluminization deposit or coating according to step 4 of the process described above, steps 2 and 3 being omitted. In this case, the aluminization deposit can be effected only by vapour phase aluminization or by aluminizing painting. A pot aluminization technique cannot be used since the rubbing of the aluminization cement powders on the unconsolidated powder deposit resulting directly from step 1 may destroy the porous layer.

EXAMPLE 1

A coating is produced on a specimen in the form of a plate measuring 20×30×2 $mm^3$ and made of DS200+Hf alloy. A first deposit is formed on the specimen by electrophoretic deposition of a CoNiCrAlY alloy powder having the composition given in the Table of FIG. 2. The grain size of the powder is centred on approximately 15 $\mu$m. The quantity of powder deposited corresponds to a density of 15 $mg/cm^2$. A second deposit is then formed on the specimen by electrolytic deposition of an alloy consisting of Pd and 20% by weight Ni. The current density used for the second deposition is 1 $A/dm^2$ and the deposition time is approximately 45 minutes. The quantity of palladium alloy deposited is therefore approximately 8 $mg/cm^2$, or approximately 35% of the total weight of metal deposited during the first two steps. In a third step a diffusion annealing of the coated specimen is performed in a secondary vacuum at 850° C. for 2 hours. Finally, in a fourth step a vapour phase aluminization using an alloy cement consisting of Cr and 30% by weight of Al, and a $NH_4F$ type activator was performed at 1100° C. for 10 hours. The resulting coating is dense and monophase and has an approximate total thickness of 80 $\mu$m. It consists mainly of a β(Ni,Co) Al phase containing, in solid solution, chromium, palladium and yttrium. FIGS. 3 and 4 show the distribution of the main elements throughout the thickness of the coating. The atomic percentages were determined by electronic microprobe analysis. The yttrium cannot be detected accurately by this kind of measurement and is detected with greater magnification by an electron microscope. FIGS. 3 and 4 show that the composition of the coating varies little within its thickness, and more particularly that the platinum group metal is present in a notable quantity throughout the thickness of the coating.

EXAMPLE 2

The same procedure is followed as in Example 1 except that in the electrolytic deposition step the quantity of palladium alloy deposited corresponds to 12 $mg/cm^2$, with a proportional increase in deposition time. The weight of the palladium alloy therefore corresponds to approximately 44% of the total weight of metal deposited in the two deposition steps. The structure of the resulting coating is identical to that of Example 1 but the content of palladium is greater (on average 15 atomic weight percent).

We claim:

1. A process for producing a coating for protecting superalloy articles against high-temperature oxidation and hot corrosion, comprising the steps of:

a) making a first deposit of a powdered alloy containing at least chromium, aluminum and an active element on an article to be coated such that said first deposit has a residual open porosity;

b) electrolytically depositing a second deposit containing at least one platinum group metal on said first deposit so as to fill said residual open porosity of said first deposit; and, c) carrying out a heat treatment to effect interdiffusion between the powder first deposit and said electrolytic second deposit whereby said platinum group metal is present throughout the thickness of the protective coating.

2. A process according to claim 1, further comprising the step of aluminizing the coating obtained from step (c) so as to enrich the coating in aluminum and complete the filling of said porosity.

3. A process according to claim 1, wherein said platinum group metal deposited in step (b) constitutes between 5 and 70% by weight of the total weight of the deposits made in steps (a) and (b).

4. A process according to claim 1, wherein said heat treatment in step (c) is carried out at a temperature between 750 and 1250° C. for a time of between 15 minutes and 48 hours.

5. A process according to claim 1, wherein said deposit of said powdered alloy is deposited electrophoretically.

6. A process according to claim 1, wherein said deposit of said powdered alloy is deposited by a painting technique utilizing a thermodegradable or volatile binder.

7. A process according to claim 1, wherein the active element in said powdered alloy is selected from the group consisting of yttrium, yttrium rare earths and lanthanide rare earths.

8. A process according to claim 1, wherein the platinum group metal is selected from the group consisting of platinum, palladium, rhodium, ruthenium, osmium, iridium and combinations of these metals.

9. A process according to claim 1, wherein a grain size of the powered alloy is between 2 and 100 $\mu$m.

10. A process according to claim 1, wherein a grain size of the powered alloy is between 4 and 15 $\mu$m.

11. A protective coating prepared by the process of claim 1.

12. A protective coating according to claim 11 on a superalloy article.

13. A protective coating according to claim 11, wherein each of the particles has a grain size between 2 and 100 $\mu$m.

14. A protective coating process according to claim 11, wherein each of the particles has a grain size between 4 and 15 $\mu$m.

* * * * *

UNITED STATES PATENT AND TRADEMARK OFFICE

CERTIFICATE OF CORRECTION

PATENT NO. : 6,183,888 B1
DATED : February 6, 2001
INVENTOR(S) : Serge A. Alperine et al.

It is certified that error appears in the above-identified patent and that said Letters Patent is hereby corrected as shown below:

Title page,
Item [75], "Alexandre Serge Alperine, Paris; Jean-Paul Fournes, Dannemois: Louis Jacques Leger, Combs la Ville, all of (FR)" should read -- Serge A. Alperine, Paris; Jean-Paul Fournes, Dannemois: Jacques-Louis Leger, Combs la Ville, all of (FR) --

Column 3,
Line 23, "in vacuo" should read -- in vacuo --;
Line 46, "in high temperature oxidation" should read -- in high-temperature oxidation --.

Column 6,
Line 46, "The coyating thickness" should read -- The coating thickness --.

Signed and Sealed this

Thirtieth Day of April, 2002

*Attest:*

*Attesting Officer*

JAMES E. ROGAN
*Director of the United States Patent and Trademark Office*